US011332277B2

(12) United States Patent
Gabriel

(10) Patent No.: US 11,332,277 B2
(45) Date of Patent: May 17, 2022

(54) APPARATUS AND METHOD FOR SEPARATION OF AIR FROM FLUIDS

(71) Applicant: Gameel Gabriel, Covington, LA (US)

(72) Inventor: Gameel Gabriel, Covington, LA (US)

( * ) Notice: Subject to any disclaimer, the term of this patent is extended or adjusted under 35 U.S.C. 154(b) by 494 days.

(21) Appl. No.: 15/831,443

(22) Filed: Dec. 5, 2017

(65) Prior Publication Data

US 2019/0168915 A1 Jun. 6, 2019

(51) Int. Cl.

| | |
|---|---|
| ***B65D 21/08*** | (2006.01) |
| ***B65D 85/72*** | (2006.01) |
| ***B65D 1/02*** | (2006.01) |
| ***B65D 81/24*** | (2006.01) |

(52) U.S. Cl.

CPC ..... *B65D 21/083* (2013.01); *B65D 1/0292* (2013.01); *B65D 81/245* (2013.01); *B65D 85/72* (2013.01)

(58) Field of Classification Search

CPC ..... B65D 21/086; B65D 81/245; B65D 83/0427; B65D 83/0072

USPC ..... 215/6; 222/105, 386.5

See application file for complete search history.

(56) References Cited

U.S. PATENT DOCUMENTS

| | | | | |
|---|---|---|---|---|
| 2,816,690 | A * | 12/1957 | Lari | B65D 83/0061 222/386.5 |
| 3,917,117 | A * | 11/1975 | Plotsky | B65D 88/66 222/94 |
| 4,892,230 | A * | 1/1990 | Lynn, Jr. | B65D 23/02 215/12.1 |
| 4,961,516 | A * | 10/1990 | Nakamura | B65D 1/0292 222/103 |
| 5,232,108 | A * | 8/1993 | Nakamura | B29B 11/08 215/10 |
| 5,433,346 | A * | 7/1995 | Howe | B65D 77/06 222/105 |
| 8,453,860 | B2 | 6/2013 | Otero | |
| 8,561,853 | B2 | 10/2013 | De Mei | |
| 9,199,785 | B2 | 12/2015 | Kneer | |
| 9,238,527 | B2 | 1/2016 | Kakuta et al. | |
| 9,556,012 | B2 | 1/2017 | Leys et al. | |
| 2008/0190961 | A1* | 8/2008 | Wyner | B05B 11/00412 222/207 |
| 2010/0230438 | A1 | 9/2010 | Sardo, Jr. | |
| 2014/0061234 | A1 | 3/2014 | Eldreth | |
| 2015/0284163 | A1 | 10/2015 | Manwani et al. | |

* cited by examiner

*Primary Examiner* — Anthony D Stashick
*Assistant Examiner* — Raven Collins
(74) *Attorney, Agent, or Firm* — Kenneth L. Tolar

(57) ABSTRACT

An apparatus and method for separation of air from fluids, whereby a contractable partition, a throat seal, and air vents are provided, which allow an inside portion behind the contractable partition to expand into or contract from an outside portion, increasing or decreasing the side of the inside portion to accommodate changing volumes of beverage, thereby preventing the entry of contaminating air and slowing the loss of carbonation of the remaining beverage.

24 Claims, 9 Drawing Sheets

APPARATUS AND METHOD FOR SEPARATION OF AIR FROM FLUIDS

BACKGROUND

This invention provides an apparatus and method for separation of air from fluids, whereby a contractable partition, a throat seal, and air vents are provided, which allow an inside portion behind the contractable partition to expand into or contract from an outside portion, increasing or decreasing the side of the inside portion to accommodate changing volumes of beverage, thereby preventing the entry of contaminating air and slowing the loss of carbonation of the remaining beverage.

When a sealed container, such as a bottle of beverage fluid like soda, wine, or milk, is opened and part of the fluid removed from the bottle, ambient air flows into the container. This ambient air fills the void left by the removed fluid, and equalizes the pressure inside and outside of the container.

In most cases, entry of such air into a partially-filled container will introduce contaminants featured in the air, such as microorganisms that in turn have an opportunity to multiply and spoil the beverage during storage. In some cases, such as when air enters a baby bottle of milk or formula, the entry of air would be especially unwanted because the baby might ingest the air and the contaminants contained within the air.

Some beverages contained in a bottle may be carbonated. More specifically, carbonation of beverages such as soft drinks, soda pop, beer, sparking wine and wine coolers, and the like is the incorporation of carbon dioxide ($CO_2$) gas into water of the liquid beverage, which technically produces carbonic acid, an extremely weak acid. Carbonation produces a fizz, and greatly improves the taste, mouth feel, and palatability of the beverage. Because yeasts, when fermenting a beverage, generate carbon dioxide, carbonation can be produced naturally during production of some beverages. However, in most cases, carbon dioxide is injected into the beverage via tanks of carbon dioxide under pressure, ultimately achieving the high level of carbonation desired by the beverage manufacturer. Accordingly, carbonated beverages are sent out from their production facilities under elevated pressure of carbon dioxide, in well-sealed containers like bottles and cans. When the sealed container is opened, the carbon dioxide incorporated into the beverage starts to escape as gas bubbles, and that escape process continues until the beverage goes completely "flat" (i.e., has no more carbon dioxide present in the beverage), if the beverage is not consumed prior to the carbon dioxide disappearing.

If the carbonated beverage is shipped in, or is later poured into, a resealable container, then there will no longer be an increased pressure of carbon dioxide in the air-filled spaces of the container after the initial opening of the container. Those spaces are filled with plain air at normal pressure. Under those conditions, carbon dioxide incorporated into the beverage will escape into the air space, making the beverage flatten or become less carbonated.

There is therefore a need for a beverage container that prevents the entry of air and preserves the carbonation of a beverage over time, and throughout repeated opening and closing of the container.

Several inventors have developed various bladder-containing beverage bottles for dispensation of a certain liquid. However, most of these prior art devices are geared towards efficient dispensation of the liquid, by utilizing a bladder in a way that provides for the liquid to be guided out through the beverage container upon continuous dispensation of the liquid. Prior art does not provide a solution geared to preserving the carbonation of the beverages.

For example, U.S. Publication No. 2010/0230438, published by Vincent Sardo, Jr. on Sep. 16, 2010, discloses a "Dispensing Bottle." The Sardo concept provides for a plastic bottle fitted with a one-way check valve and an inner bladder containing a substance such as mustard or ketchup. When squeezed, the substance is dispensed from an inner bladder through an aperture in the top. When released, air is allowed into the bottle through the valve to displace the substance dispensed. Since the valve will not allow air out of the bottle, the bladder continuously shrinks, until all the substance is dispensed, without any waste or the need to either strike the bottle or to store it upside down. No air comes into contact with the substance, thus avoiding bacterial contamination.

U.S. Publication No. 2015/0284163 was published by assignee Kuvee, Inc. on Oct. 8, 2015, disclosing a "Container for Preserving Liquid Contents." The beverage container, created by inventors Vijay Girdhar Manwani et al., includes a flexible inside container and a rigid outside container. The flexible container can retain a liquid and seal the liquid from environmental air, while the surrounding rigid container facilitates handling and pouring in a form factor that reproduces the look and feel of a conventional wine bottle. A one-way valve permits pouring from the flexible container while preventing ingress of atmospheric oxygen or other contaminants. In particular, the one-way valve can be configured to retain a beverage within the flexible container until an exit path for the beverage through the valve is filled with liquid to seal the exit path and effectively eliminate any return path for ingress of air. To create a bottle-like pouring experience, the valve may automatically open to allow for the pouring of fluid when the bottle is tilted, and the valve may automatically close at the end of a pour.

U.S. Pat. No. 9,238,527, issued on Jan. 19, 2016 to Yoshiyuki Kakuta et al., covers a "Dispensing Container." The dispensing container provides that after discharging content, the content that has not been returned to an internal container is prevented from leaking out of a discharge port. The dispensing container includes (a) a container body with a flexible internal container to contain content, and that deforms so as to deflate with a decreasing amount of the content, and an external container in which the internal container is attached, where the external container is provided with a suction port for sucking external air in between the internal container and the external container; (b) a discharge cap that is attached to a spout of the container body, and is provided with a discharge port for discharging the content; (c) an external-air inlet port that communicates between the outside and the suction port; and (d) an air valve that switches between a communicated state and a shutoff state of communication between the external-air inlet port and the suction port. The dispensing container is further designed such that the discharge cap includes an inside plug member that closes the spout, and a cylindrical body member with a top-closed cylindrical shape, with the cylindrical body member covering the inside plug member and featuring the discharge port. The inside plug member is also provided with a communication port, which communicates between the discharge port and the internal container. Lastly, a valve body is arranged and fitted in the communication port so as to be slidable along an axial direction of the communication port, with the valve body being elastically displaced along the axial direction so as to open and close the communication port.

U.S. Pat. No. 8,453,860 was issued to Efrain Otero on Jun. 4, 2013 for a "Bottle with Ratcheting Base and Inner Bladder." The bottle was designed to remove the excess air in an opened, partially used bottle containing effervescent beverages. Further use of the bottle can be employed when viscous substances are contained. These purposes are achieved by rotating a base of a bottle that is connected to a tab at the bottom of an inner bladder liner, which is in turn contained inside a bottle. The bottle system is used for dispensing and maintaining effervescent beverages fresher for a longer period of time after a bottle has been opened. The bottle also improves the dispensing of thick substances found in many products that have viscous properties. The system offers a more efficient solution for dispensing of such substances from their containers by employing a collapsible inner bladder liner contained inside a bottle.

U.S. Publication No. 2014/0061234 was published by David C. Eldreth on Mar. 6, 2014, and discloses a "Serving and Preserving System." The system provides for embodiments of a container system for ingestion by humans, and a method of storing and dispensing liquids for ingestion that include at least one first structure in the general shape of a bottle. The system further includes at least one partially flexible container, positioned at least partially in an inner space, and at least one liquid passageway and one air purger that is capable of purging air out of the partially flexible container through at least one opening. The system also provides at least one ball check valve and at least one manually initiated valve, and additionally features embodiments of an air pump purging system and a method for an air pump purging system for the liquid container system. The flexible container within the system is typically made of or lined in a material similar to plastic, rubber, or silicone, such that the liquid contained therein can be inserted into and/or stored in the flexible container. The interior may also be made with or lined with a food-grade material. When gravity causes liquid to flow out of the otherwise sealed flexible container that is not in an airtight container, a vacuum can be created in the flexible container that will enable the flexible container to compress inward. The flexible container featured in the Eldreth publication will be sufficiently flexible so that if the container contains a liquid and the flexible container is not surrounded by an airtight outer container, the flexible container will be able to collapse on itself rather than maintaining the space originally occupied by the liquid when the flexible container is partially inverted, such that the liquid will flow out of the flexible container appropriately.

U.S. Pat. No. 8,561,853, issued on Oct. 22, 2013 to Mauro De Mei, covers an "Airtight Preservation System." The Mei patent discloses an airtight preservation system of a consumer fluid within a container, and particularly a system for preservation of the fluid, where the fluid would typically be intended for alimentary consumption, from contamination by contact with outside atmosphere. The system was designed to be easily installed, by virtue of a compact structure applicable to any container size. The device of the system is preferably of substantially cylindrical shape, internally connected with a case. The case is made integral to the container by a removable fitting substantially at an inlet thereof. The system further includes a plug, connected with the device, and having a delivery spout and a through hole, as well as a compensation casing with an inlet mouth, connected to the system by a connecting manifold internal to the case. Inside the compensation casing, a substitute fluid is present. The substitute fluid would preferably be gaseous, and would typically be air coming from an outside environment into the container. The system arranges, at a variation of the internal volume of the container taken up by the consumer fluid concomitantly to a delivery of the fluid, a proportional flow of substitute fluid into the compensation casing in order to compensate for the internal volume variation, and to keep the overall pressure internally of the container at a substantially constant predetermined value.

U.S. Pat. No. 9,199,785 was issued to assignee Gaplast GmbH on Dec. 1, 2015, covering a "Container Having an Inner Bag." The container, created by inventor Roland Kneer, is produced in a coextrusion-type blow molding process. The container consists of a substantially rigid outer container and an easily deformable inner bag, with the inner bag being closed by a bottom weld seam when excess material is squeezed off at the bottom of a blow mold. The bottom weld seam is clamped in a likewise closed bottom weld seam of the outer container. The container further provides for at least one pressure compensating opening, formed on both sides of the bottom weld seam, and where all pressure compensating openings are formed at points of the outer container that are offset in the circumferential direction from the intersection lines of a plane extending through the bottom weld seam and through the longitudinal center axis of the container with the circumferential wall of the outer container and of the inner bag. In this manner, the inner bag contracts only from two sides when the container contents are dispensed. The wall thickness of the inner bag is greater in the area of the intersection lines than in the interposed circumferential portions.

Lastly, U.S. Pat. No. 9,556,012 was issued to inventors John A. Leys et al. on Jan. 31, 2017 for a "Pressurized System for Dispensing Fluids." The system provides for a bag-in-bag-in-bottle assembly formed by a flexible dispensing container with a dispensing fitment. The dispensing container is positioned adjacent, or sandwiched between, one or more flexible pressurization containers having a separate inlet/outlet path through a second fitment. The bag-in-bag assembly can then be placed in a containment vessel with the fitments mounted such that it is accessible on the vessel. A liquid can be extracted from the dispensing container by introducing a fluid into the pressurization containers with enough pressure to force the liquid out through the dispensing fitment. A contoured dispensing head may be coupled to the bag-in-bag-in-bottle assembly using a cam actuation arrangement for simultaneously locking the pressurization, vent, and fluid extraction couplings. In operation of the device, the inner flexible container is completed filled with fluid, and the outer flexible container has been emptied by the pressure exerted against it by the inner flexible container as it was filled and its outer surface pressed against the inner surface of the containment vessel that houses the bag-in-bag assembly. Then a portion of the fluid contained in the inner flexible container is dispensed, due to the pressure created by the introduction of a gas into the outer flexible container. As more gas is introduced into the outer flexible container, the inner flexible container is uniformly compressed. That uniform compression can result in nearly total dispensation of the fluid contained in the inner flexible container.

There accordingly remains a need for a beverage container system and method that preserves carbonation, over time and throughout repeated opening and closing of the beverage container, and further prevents the entry of contaminating air into the beverage container.

SUMMARY OF THE INVENTION

This invention provides an apparatus and method for separation of air from fluids, whereby a contractable partition, a throat seal, and air vents are provided, which allow an inside portion behind the contractable partition to expand into or contract from an outside portion, increasing or decreasing the side of the inside portion to accommodate changing volumes of beverage, thereby preventing the entry of contaminating air and slowing the loss of carbonation of the remaining beverage.

BRIEF DESCRIPTION OF DRAWINGS

Reference will now be made to the drawings, wherein like parts are designated by like numerals, and wherein.

DETAILED DESCRIPTION OF THE INVENTION

Figure 1:
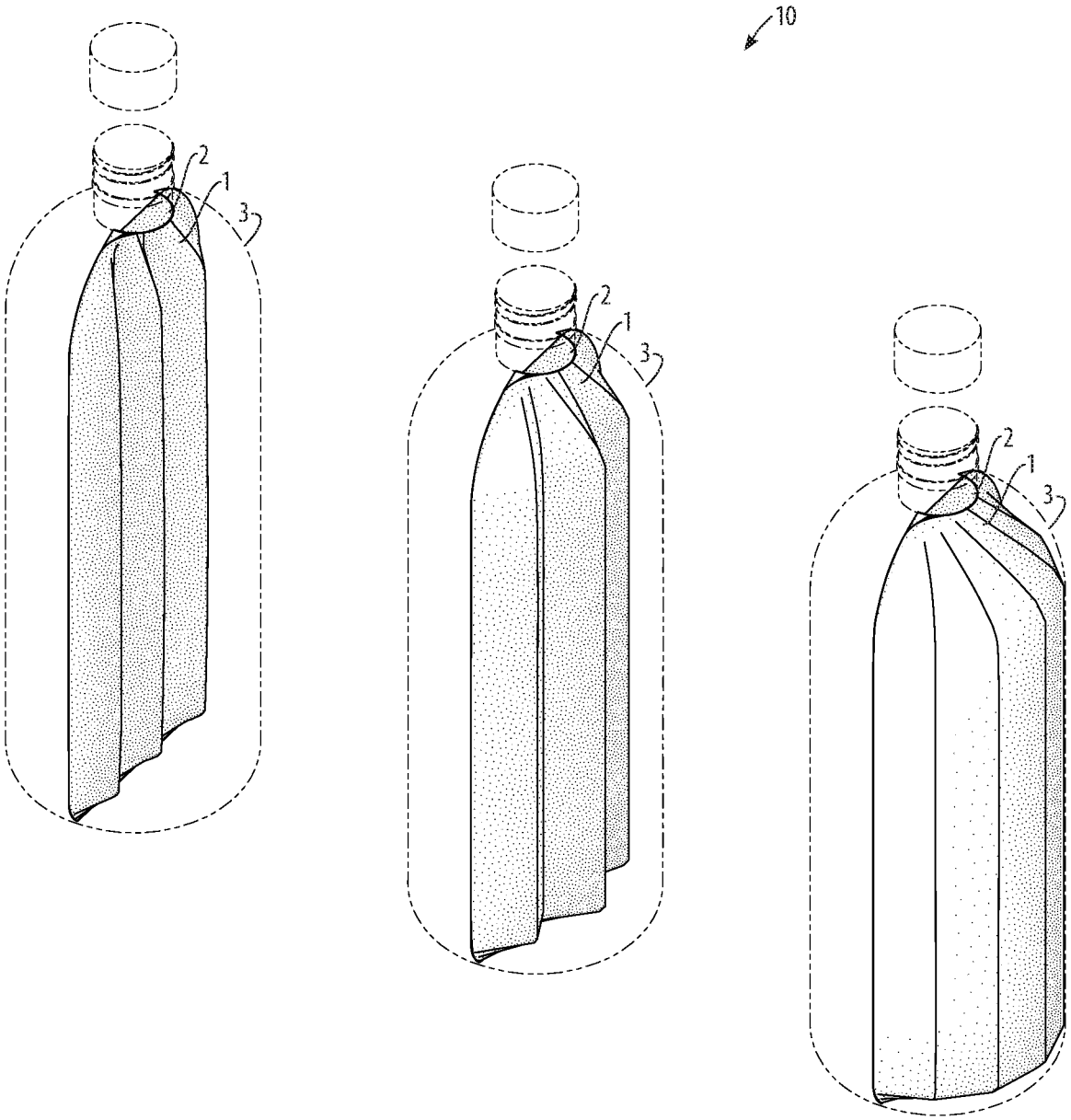
FIG. 1 is a perspective view of three stages in the use of the invention.

Referring to FIG. 1 and all of the figures generally, the apparatus and method for separation of air from fluids 10 of the invention is shown in three stages of use. The apparatus for separation of air from fluids provides a contractable partition 1, sealing off a portion of a container, such as the bottle illustrated. This contractable partition 1 creates an inside portion and an outside portion of the interior of the container, with reference to the contractable partition 1.

A throat seal 2 is attached to the contractable partition 1, and serves to seal the throat of the container such that the throat of the container opens only into the inside partitioned portion, and not into the outside portion.

Figure 2:
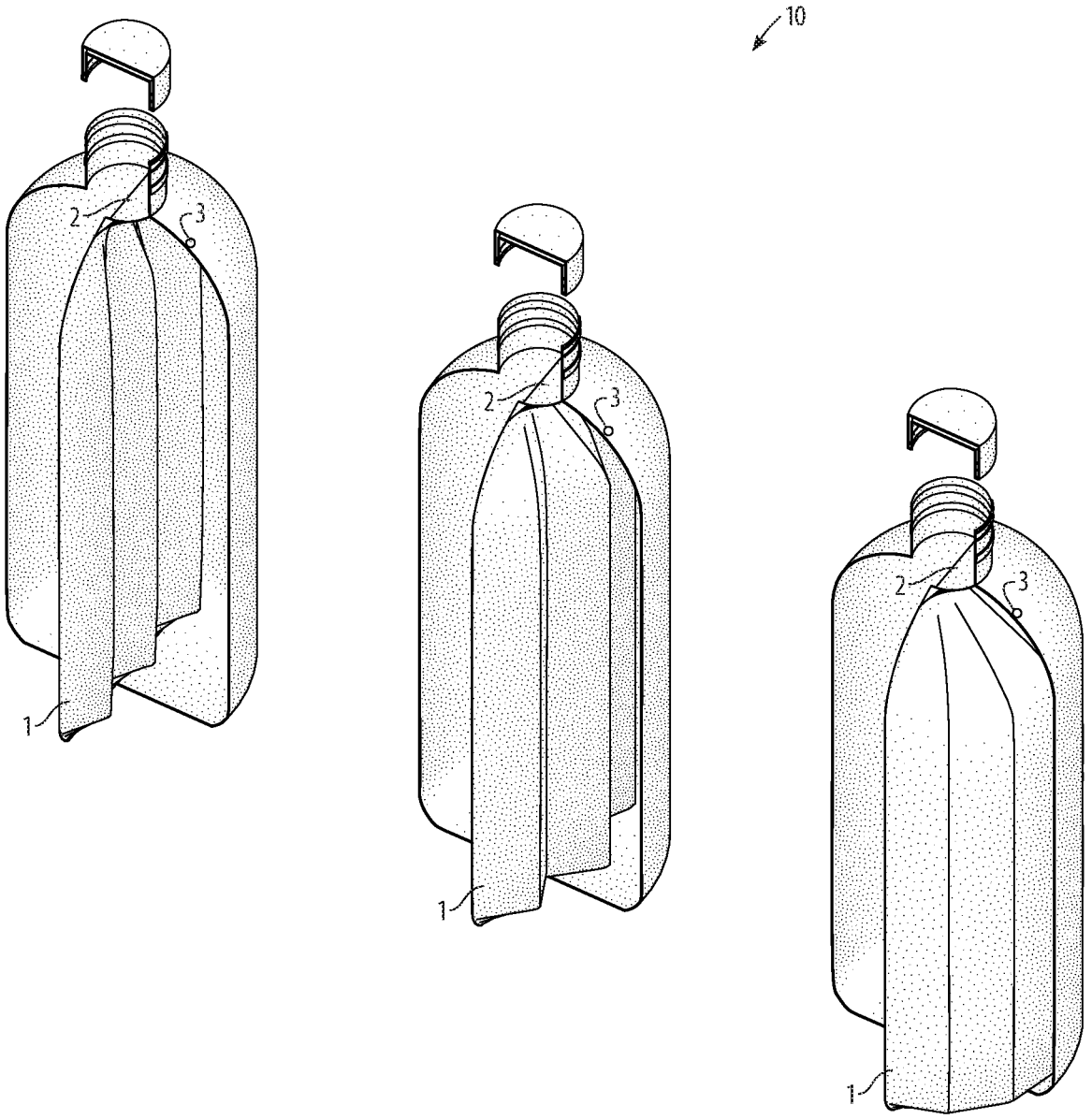
FIG. 2 is a partially cutaway perspective view of three stages in the use of the invention.

Referring to FIG. 2, one or more air vents 3 are provided in the container surface that corresponds to the outside portion, in order to allow for the equilibration of air pressure as the contractable partition 1 expands and contracts. The number of air vents 3 can vary, provided the total opening area is sufficient to allow an essentially instant equilibration of pressure. For example and without limitation, on a container of a size that a person would traditionally be able to manipulate, one air vent 3 of approximately one-quarter inch, or 6 millimeters, in diameter would be sufficient. In the present invention, if only one air vent 3 is used, that single air vent should not be placed at a position that is likely to be covered and blocked by a fully expanded contractable portion 1. At the other extreme, the entire surface of the bottle corresponding to the outside portion may be perforated, provided that sufficient structural integrity is maintained on the container.

Figure 3:
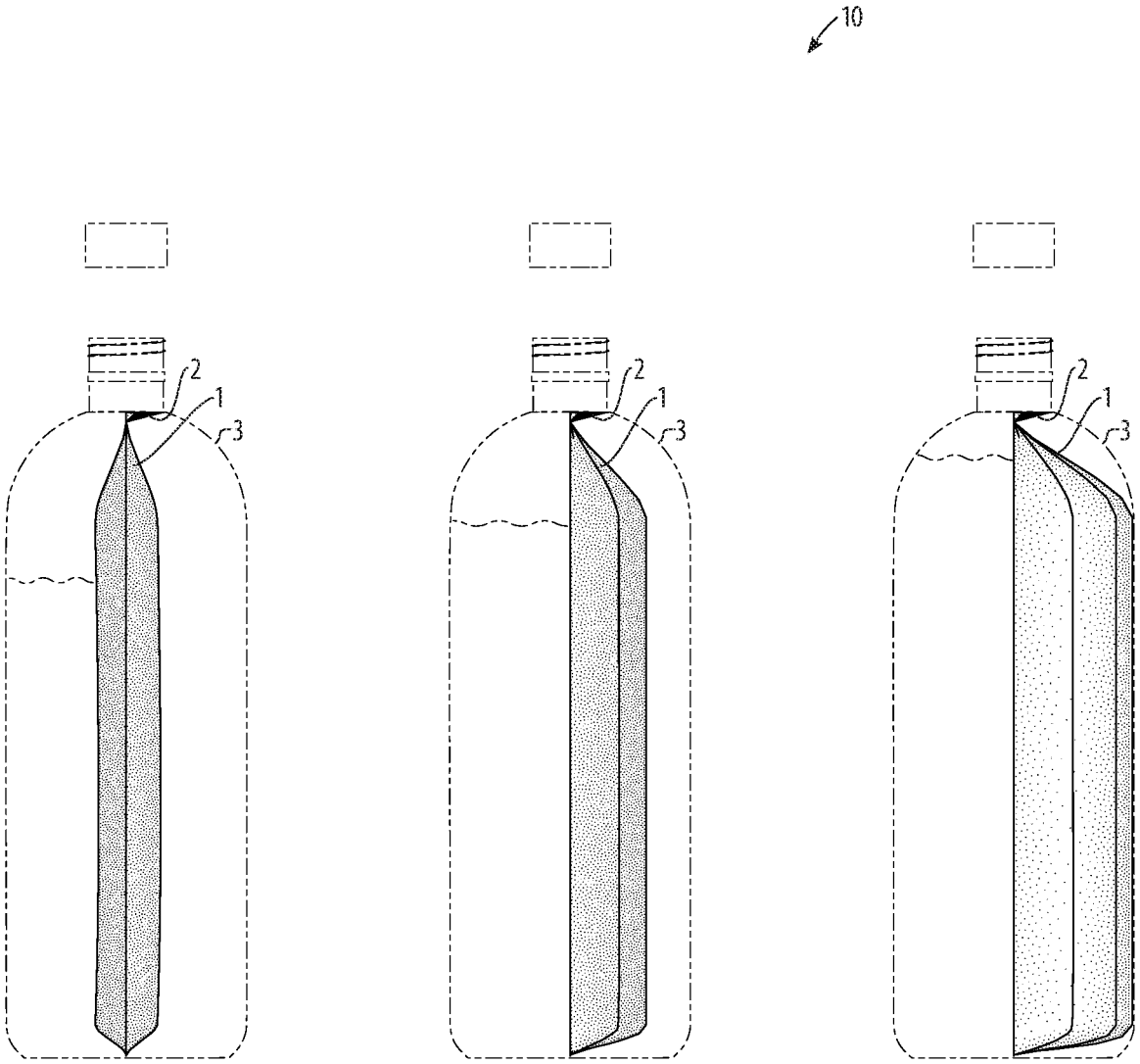
FIG. 3 is a front view of three stages in the use of the invention.
Figure 4:
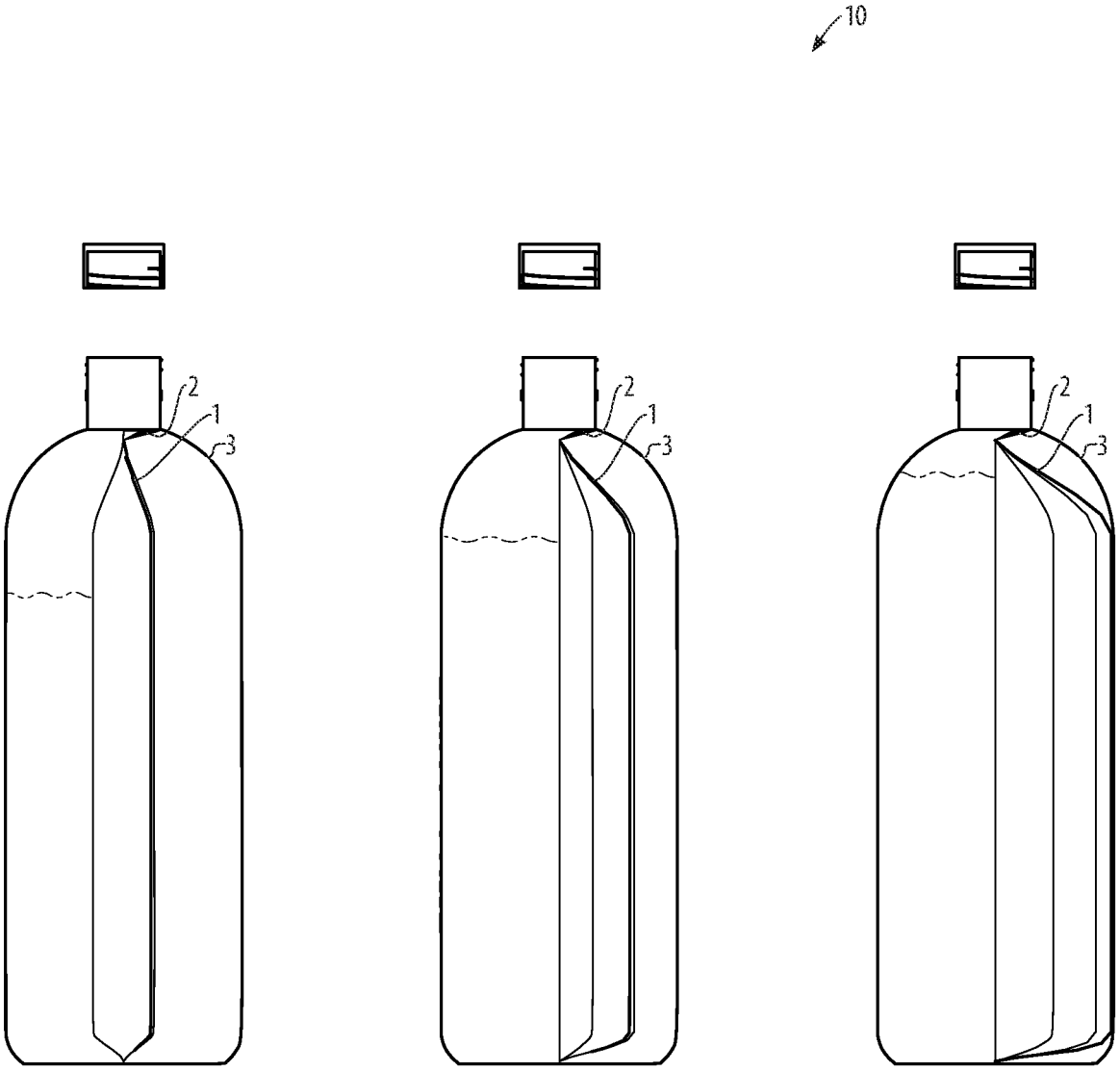
FIG. 4 is a cross-sectional front view of three stages in the use of the invention.

Referring to FIG. 3 & FIG. 4, in use, the separation of air from fluids apparatus 10 conforms to the amount of carbonated beverage present in the inside portion of the bottle. The contractable partition 1 expands into the outside portion of the bottle to accommodate a larger volume of the beverage, and contracts as the beverage is poured out of the container, leaving a lesser volume of beverage remaining in the container.

In the illustrated embodiment, the contractable partition 1 is made from a material such as rubber or silicone rubber, which can be stretched and which returns to its original shape after stretching. This stretching should not take a large amount of force to achieve, and the material should not exert a large amount of force in returning to shape, because an excessive amount of force would likely push the beverage out of the container in an undesirable manner. The present invention further provides for the material to be arranged in folded or accordion-folded fashion, which allows the contractable partition 1 to move into and out of the outside portion. The tendency of the folded material to return to shape, like the contractable partition 1, should also not be strong and aggressive.

Figure 8:
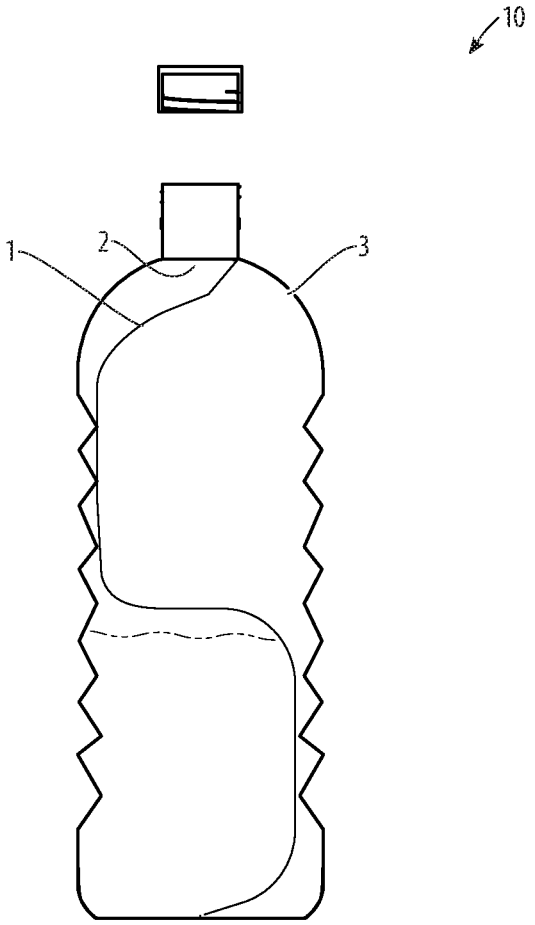
FIG. 8 is a sectional view of an embodiment of the invention having collapsible sides.

Referring to FIG. 8, when the container is upright, the fluid will go to the bottom of the container through the action of gravity. The lower portion of the contractable partition 1 will expand to accommodate the fluid, and the upper portion will contact. The center of gravity of the fluid is thus maintained at the bottom of the container, which provides higher stability for the container.

Figure 5:
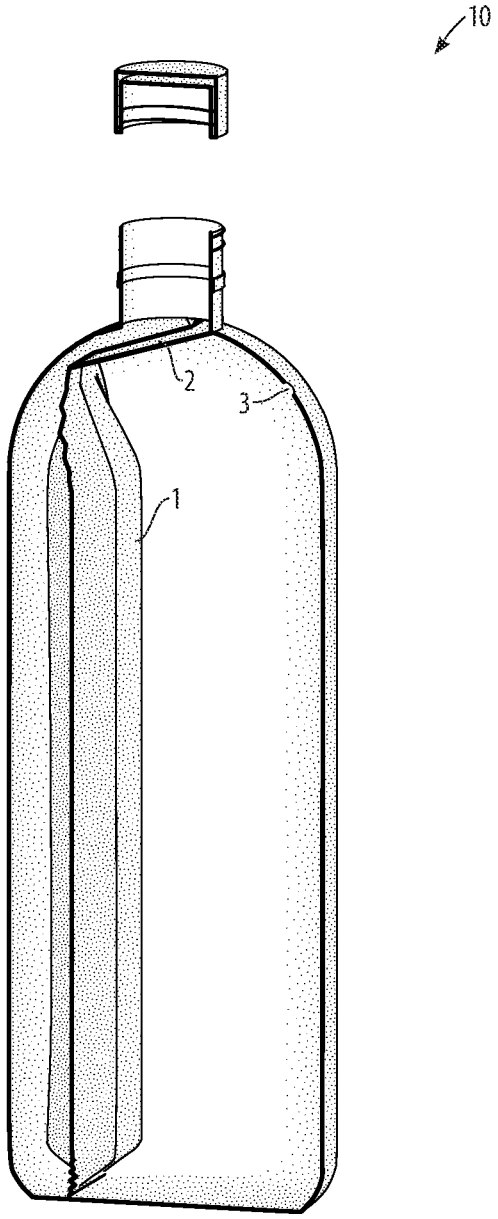
FIG. 5 is a sectional perspective view of an embodiment of the invention having an off-center placement of the contractable partition.
Figure 7:
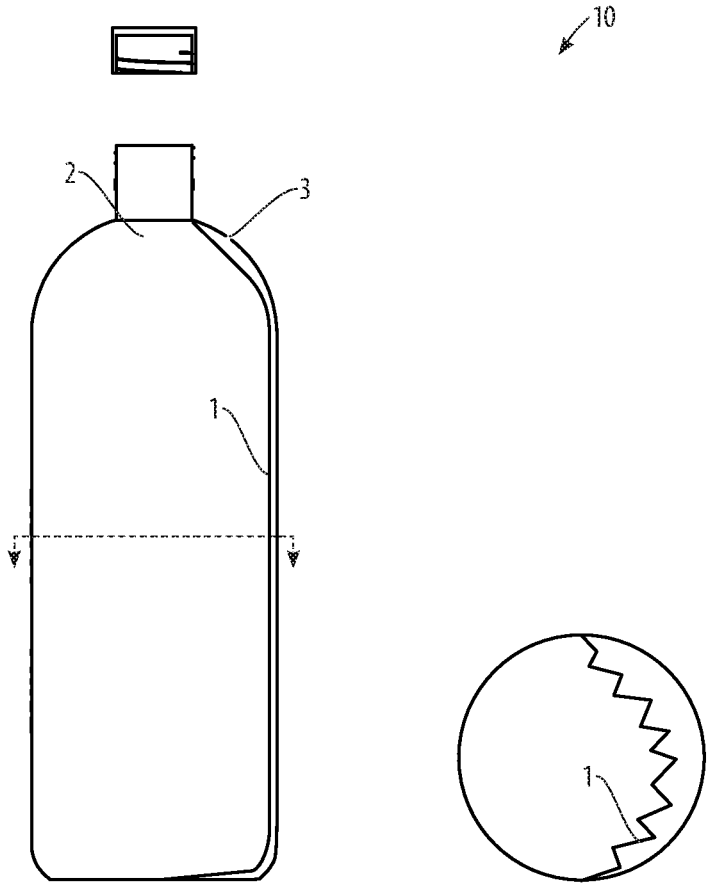
FIG. 7 is two sectional views of an embodiment of the invention having an off-center placement of the contractable partition.
Figure 9:
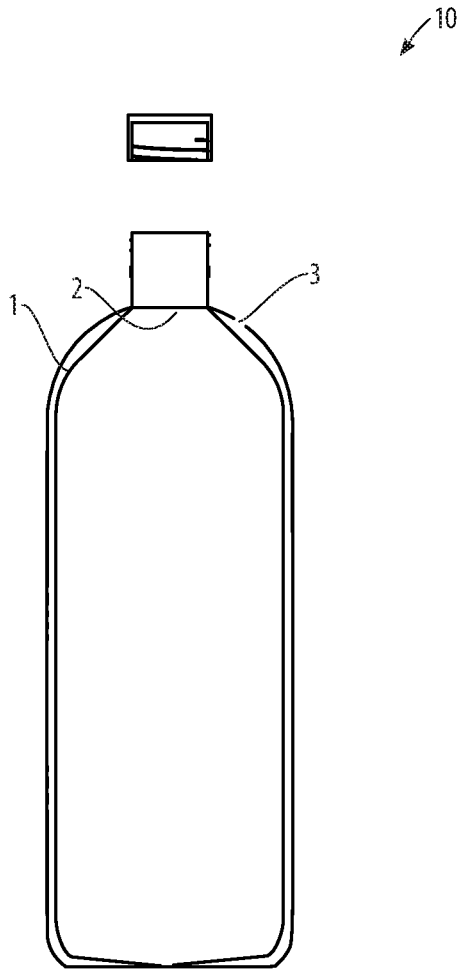
FIG. 9 is a sectional view of an embodiment of the invention.

Referring to FIGS. 5, 7, and 9, the location of the contractable partition 1, and therefore the minimum size of the inside portion, can be at various locations within the container. The configuration of the throat seal 2 can also be altered to make the throat of the container open only into the inside partitioned portion, and not into the outside portion.

Figure 6:
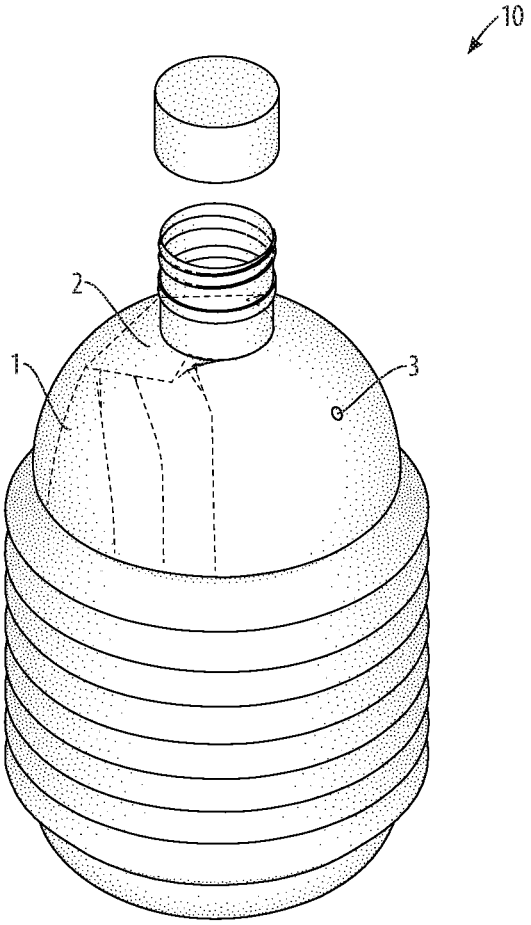
FIG. 6 is a perspective view of an embodiment of the invention having a collapsible beverage container.

Referring to FIG. 6 and FIG. 8, the container can be collapsible in order to save space when the volume of beverage in the inside portion behind the contractable partition is low.

Many other changes and modifications can be made in the apparatus and method of the present invention without departing from the spirit thereof. I therefore pray that my rights to the present invention be limited only by the scope of the appended claims.

I claim:

1. A separation of air from fluids apparatus for reducing carbonation loss in an open and resealed volume of beverage, the separation of air from fluids apparatus comprising:

(i) a contractible partition adapted to seal off a portion of a container, said partition having two opposing side edges and a bottom edge, a first of said side edges attached to an inner surface of said container, a second of said side edges attached to an opposing portion of the inner surface of said container, and the bottom edge attached to a lower inner surface of said container, creating an inside portion for storing the beverage and an outside portion within the container, and adapted to expand and contract to accommodate varying volumes of beverage within the inside portion;

(ii) a throat section of said beverage container, featuring a throat seal attached to the contractible partition and adapted to seal off the throat section of the container from communication with the outside portion, and said throat seal allowing an entire portion of said throat section to be in communication with the inside portion behind said contractible partition thereby eliminating air intrusion into the beverage while allowing the beverage to be dispensed from said container; and (iii) at least one air vent in the container surface corresponding to the outside portion, adapted to allow rapid equilibration of air pressure between the outside portion and ambient air pressure; and where, in use, said contractible partition expands or contracts to accommodate varying volumes of beverage within the inside portion while reducing the volume of air space above the beverage, thereby preventing the entry of contaminating air and reducing loss of carbonation.

2. The separation of air from fluids apparatus of claim 1, further adapted for use within a bottle-type beverage container.

3. The separation of air from fluids apparatus of claim 1, where said contractible partition is placed essentially in the middle of the beverage container.

4. The separation of air from fluids apparatus of claim 1, where said contractible partition is placed so as to form an inside portion having a volume that is less than the outside portion one-half the volume of the beverage container.

5. The separation of air from fluids apparatus of claim 1, further adapted for use with a collapsible beverage container.

6. The separation of air from fluids apparatus of claim 1, where at least one said air vent is located near the throat of the beverage container.

7. The separation of air from fluids apparatus of claim 1, where at least one said air vent is located near the base of the beverage container.

8. The separation of air from fluids apparatus of claim 1, further adapted for use with a screw-cap-bottle beverage container.

9. The separation of air from fluids apparatus of claim 1, where said contractible partition and said throat seal further comprise a rubber material.

10. The separation of air from fluids apparatus of claim 1, where said contractible partition and said throat seal further comprise a silicone rubber material.

11. A method of separating air from fluids for reducing carbonation loss in an open and resealed volume of beverage, the separation of air from fluids method comprising:

(i) providing a separation of air from fluids apparatus, said apparatus comprising:

(a) a contractible partition adapted to seal off a portion of a container, said partition having two opposing side edges and a bottom edge, a first of said side edges attached to an inner surface of said container, a second of said side edges attached to an opposing portion of the inner surface of said container and the bottom edge attached to a lower inner surface of said container, creating an inside portion and an outside portion within the container, and adapted to expand and contract to accommodate varying volumes of beverage within the inside portion;

(b) a throat section of said beverage container, featuring a throat seal attached to the contractible partition and adapted to seal off the throat section of the container from communication with the outside portion, such that the entire throat section is in communication with the inside portion behind said contractible partition; and (c) at least one air vent in the container surface corresponding to the outside portion, adapted to allow rapid equilibration of air pressure between the outside portion and ambient air pressure; and (ii) using said separation of air from fluids apparatus, where, in use, said contractible partition expands or contracts to accommodate varying volumes of beverage within the inside portion while reducing the volume of air space above the beverage, thereby preventing the entry of contaminating air and reducing loss of carbonation.

12. The separation of air from fluids method of claim 11, where said separation of air from fluids apparatus is further adapted for use with a bottle-type beverage container.

13. The separation of air from fluids method of claim 11, where said contractible partition is placed essentially in the middle of the beverage container.

14. the separation of air from fluids meghod of claim 11, where said contractible partition is placed so as to form an inside portion less than one-half the volume of the beverage container.

15. The separation of air from fluids method of claim 11, where said contractible partition is placed so as to form an inside portion less than one-half the volume of the beverage container.

16. The separation of air from fluids method of claim 11, where said separation of air from fluids apparatus is further adapted for use with a collapsible beverage container.

17. The separation of air from fluids method of claim 11, where at least one said air vent is located near the throat of the beverage container.

18. The separation of air from fluids method of claim 11, where at least one said air vent is located near the base of the beverage container.

19. The separation of air from fluids method of claim 11, where said separation of air from fluids apparatus is further adapted for use with a screw-cap-bottle beverage container.

20. The separation of air from fluids method of claim 11, where said contractible partition and said throat seal further comprise a rubber material.

21. The separation of air from fluids method of claim 11, where said contractible partition and said throat seal further comprise a silicone rubber material.

22. The separation of air from fluids apparatus of claim 1 wherein the contractible partition is folded in an accordion-type fashion which allows the contractible portion to freely expand into and contract out of the outer portion.

23. The separation of air from fluids apparatus of claim 1 wherein the container surface corresponding to the outside portion is perforated to provide additional venting and to prevent the contracting partition or a user's hand to hinder equilibration of air pressure between the outside portion and ambient air pressure.

24. The separation of air from fluids apparatus of claim 1 wherein the contractible partition is adapted and configured such that when the container is upright, and fluid gravitates near a bottom portion of the container, a lower portion of the contractible partition expands and an upper portion of the contractible partition contracts whereby a center of gravity of the fluid is biased toward the bottom portion of the container to further ballast the apparatus.

* * * * *